United States Patent [19]

Mori

[11] 4,244,658

[45] Jan. 13, 1981

[54] DOT PRINTER HEAD

[75] Inventor: Masahiko Mori, Shiojiri, Japan

[73] Assignee: Kabushiki Kaisha Suwa Seikosha, Tokyo, Japan

[21] Appl. No.: 8,637

[22] Filed: Feb. 1, 1979

[30] Foreign Application Priority Data

Feb. 1, 1978 [JP] Japan .....53-10905

[51] Int. Cl.[3] ..... B41J 3/12

[52] U.S. Cl. ..... 400/124; 101/93.05

[58] Field of Search ..... 400/124; 101/93.05; 335/276

[56] References Cited

U.S. PATENT DOCUMENTS

| | | | |
|---|---|---|---|
| 3,477,049 | 11/1969 | Kreidler | 335/276 |
| 3,929,214 | 12/1975 | Hebert | 400/124 |
| 4,009,772 | 3/1977 | Glaser et al. | 400/124 |
| 4,060,161 | 11/1977 | Nelson et al. | 400/124 |
| 4,136,978 | 1/1979 | Bellinger et al. | 400/124 |
| 4,165,940 | 8/1979 | Cacciola | 400/124 |

FOREIGN PATENT DOCUMENTS

| | | | |
|---|---|---|---|
| 2119641 | 11/1972 | Fed. Rep. of Germany | 400/124 |
| 2201049 | 7/1973 | Fed. Rep. of Germany | 400/124 |

*Primary Examiner*—Paul T. Sewell

*Attorney, Agent, or Firm*—Blum, Kaplan, Friedman, Silberman & Beran

[57] ABSTRACT

In a dot printer head, a small, thin and flat lever or chip pivots on a fulcrum when attracted by an electromagnetic coil. Pivoting of the chip on the fulcrum drives a needle, in opposition to a biasing spring, against an ink ribbon and paper for printing on the paper with dots. The biasing spring returns the needle after printing. The fulcrum is positioned by a resilient restraint comprising a leaf spring. The magnetic gap between the coil and chip is small but provides a long needle stroke because of the mechanical advantage in the pivoting element. The gap requires no adjustments. The printer head includes a plurality of similar independently operating needles and drive mechanisms.

10 Claims, 7 Drawing Figures

DOT PRINTER HEAD

BACKGROUND OF THE INVENTION

This invention relates generally to a printer head and more particularly to a dot printer head used to print on paper by means of a plurality of needles impacting on paper through an ink ribbon. Various structures for mechanical dot printer heads have been developed. In the prior art the needle is frequently directly attached to the armature of a solenoid and the distance that the wire is moved equals the distance that the solenoid armature is moved. The greater the distance of armature movement, the greater is the power required to operate the solenoid and the physical size of the solenoid is also increased. A common deficiency in the prior art is that the gap between an attracted surface of the movable element connected to the needle and the attracting surface of a fixed iron core of the electromagnetic solenoid, cannot be reduced by any low priced production method. Dot printer heads are expensive becauase some heads need very high precision in production, and some dot printer heads require complex adjustment of the magnetic gap for reliable operation. When low-priced dot printer heads are produced, the gap is large and more energy is required for supplying the electromagnetic coil than the electromagnet would otherwise need in order to perform the function of printing with high quality. Large solenoids also generate a high level of heat during operation. This heat must be dissipated.

What is needed is a dot printer head which drives the printing needles with solenoids having very small magnetic gaps. Good impact velocity combined with a long needle stroke is also desirable. The gap should need no adjustment and remain fixed.

SUMMARY OF THE INVENTION

Generally speaking, in accordance with the invention, a dot printer head especially suited for printing characters on paper by forming dots, is provided. In the dot printer head of this invention, a small thin and flat element lever or a chip pivots on a fulcrum when attracted by an electromagnetic coil. Pivoting of the chip on the fulcrum drives the needle, in opposition to a biasing spring, against an ink ribbon and paper for printing on the paper with characters formed of dots. The biasing spring returns the needle after printing. The fulcrum is positioned by a resilient restraint comprising a leaf spring. The magnetic gap between the coil and chip is small but provides a long needle stroke because of the mechanical advantage in the pivoting lever. The gap in the electromagnetic circuit requires no adjustments. The printer head includes a plurality of similar independently operating needles and driving mechanisms symmetrically disposed within a circular yoke.

Accordingly it is an object of this invention to provide a dot printer head wherein the gaps in the electromagnetic circuits which drive the needles, are small.

Another object of this invention is to provide a dot printer head which is economical to fabricate and provides a high level of printing quality while using low amounts of energy.

A further object of this invention is to provide a dot printer head which is easily assembled in production and uses a minimum number of parts.

Yet another object of this invention is to provide a dot printer head which has a long needle stroke in combination with a small gap in the electromagnetic circuit.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in conjunction with the accompanying drawings, in which.

DESCRIPTION OF THE PREFERRED EMBODIMENTS

Figure 2:
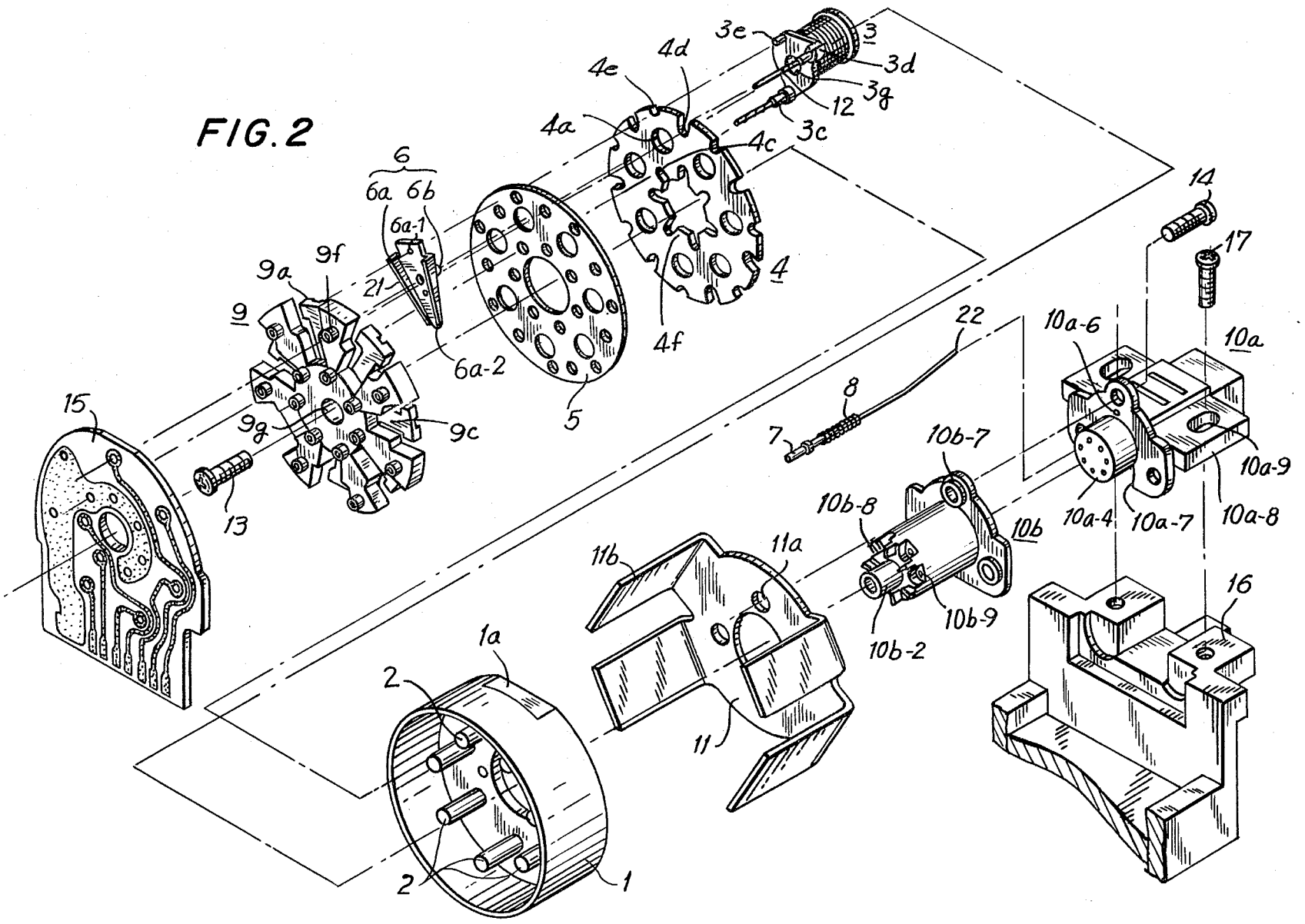
FIG. 2 is an exploded view in perspective of the dot printer head of FIG. 1.

With reference to the Figures, the first yoke 1 is shaped like a cup and seven fixed iron cores 2 are mounted symmetrically on the bottom thereof. As best seen in FIG. 2, the seven cores 2 are symmetrically arranged around the circular cup 1 and the structures associated with each iron core 2 are substantially similar. Therefore the description which follows is primarily related to a single iron core 2 and its associated structure, although the description is equally applicable to the structure surrounding each of the iron cores. The coil frame 3 is fitted within the first yoke 1 and is mounted on the fixed iron core 2. The end surface 2*a* of the fixed iron core 2 abuts the stepped portion 3*a* on the coil frame 3 and fixes the position of the coil frame 3 on the iron core 2. The second yoke 4 is a disk which nests within the first yoke 1 and rests on the surface 3*b* of the coil frame 3. That is, the coil frame 3 is held by and between the fixed iron core 2 and the seond yoke 4.

Figure 3:
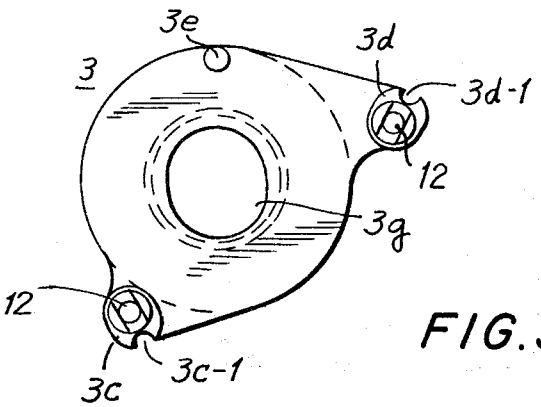
FIG. 3 is a plan view of a coil frame of the dot printer head of FIG. 1.

As means for setting the relative position between the coil frame 3 and the second yoke 4, the coil frame 3 is provided with position locating projections 3*c*, 3*d* and a fulcrum projection 3*e* as more fully described hereinafter. The second yoke 4 is provided with guide notches 4*d*, 4*e* around it outer circumference and notches 4*c* which are symmetrically located around an inner opening in the yoke 4. These notches 4*c*, 4*d*, 4*e* in the second yoke 4 register with the projections 3*c*, 3*d*, 3*e* on the coil frame 3. The relative positions of the coil frame 3 and the second yoke 4 are determined by inserting and fitting the position locating projections on the coil frame 3 into the guide notches on the second yoke 4. The position locating projections 3*c*, 3*d* of the coil frame 3 include longitudinal U-shaped recesses 3*c*-1 and 3*d*-1 respectively on the periphery thereof (FIG. 3). End leads of the coil 3*f* which is wound on the coil frame 3, pass through the U-shaped recesses 3*c*-1, 3*d*-1 and connect with respective coil lead terminals 12. The lead terminals 12 are pressed into the position locating projections 3*c*, 3*d* on the coil frame 3.

The thin, basically flat lever or chip 6 is pivotably mounted on the opposite side of the second yoke 4 from the coil frame 3 with the spacer 5 interposed between the movable chip 6 and the second yoke 4. The spacer 5 is approximately 0.1 millimeters thick. As best seen in FIG. 2 the lever or chip 6 is somewhat triangular in shape having a wide end and a narrow end 6*a*-2. Side flanges 21 provide rigidity for the chip 6 and produce a U-shaped cross-section. The movable chip 6 comprises the lever element or base 6*a* and the iron core 6*b* is fixedly attached to the base 6*a*. The movable iron core 6*b* is in position to be directly attracted to the end surface 2*a* of the fixed iron core when the magnetic coil 3*f* is energized. The base of the chip 6 is bent slightly near the wide end to provide a contact point, or fulcrum, for pivoting the lever or chip 6. The endurance of the spacer 5 is greatly improved by the bending to provide a rolling contact point 20 on the lever 6. Smoothness in the oscillation of the movable chip or lever 6 is also improved. The other end 6*a*-2 of the lever base 6*a* engages with the needle 7, and the needle 7 is aligned and supported by the needle guide 10. The position of the contact point 20 on the spacer 5 is fixed by inserting and fitting the fulcrum projection 3*e* on the coil frame 3 in the aperture 6*a*-1 provided at the wide end of the iron lever 6*a*.

Figure 1:
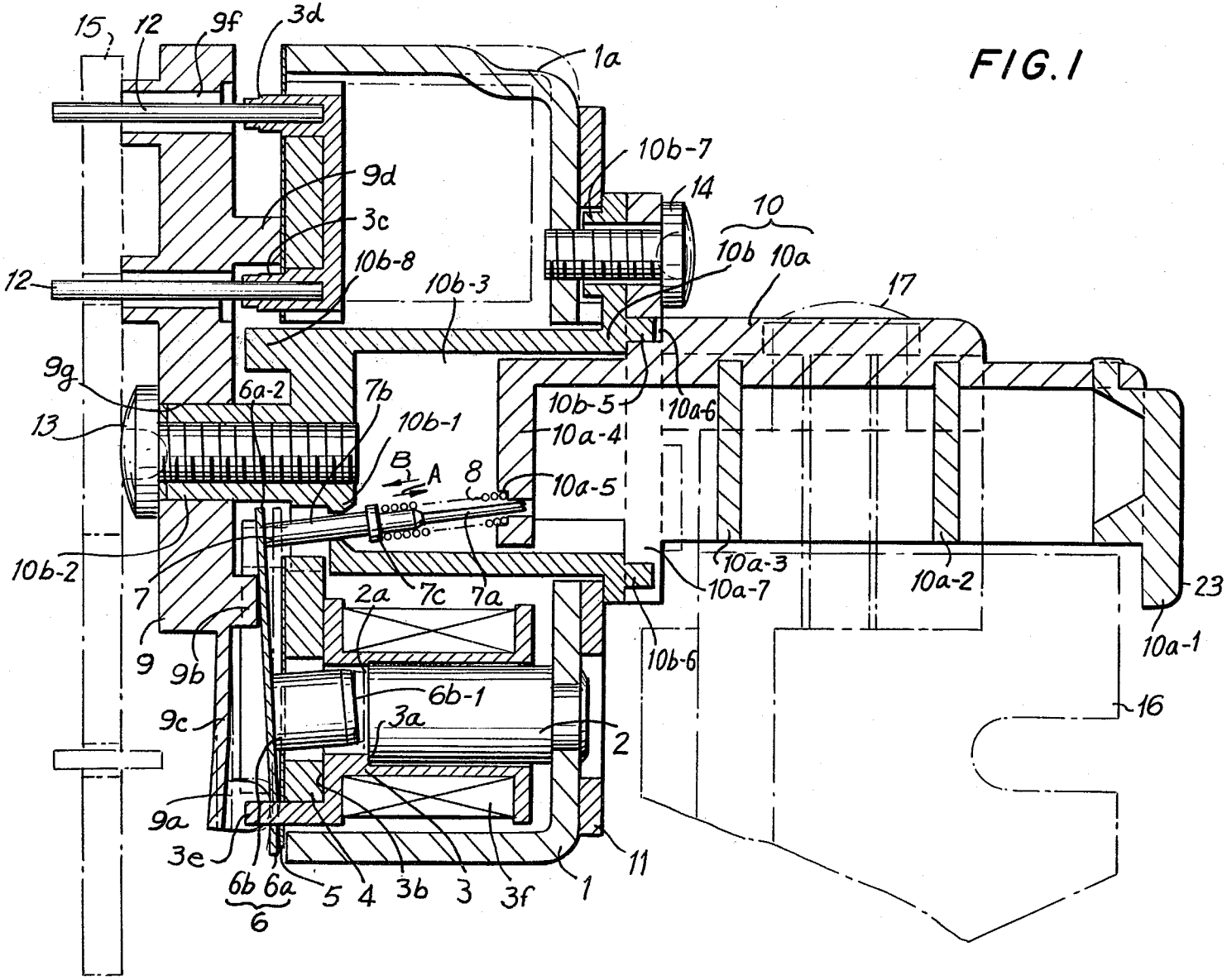
FIG. 1 is a cross-sectional view of the dot printer head of this invention.
Figure 6:
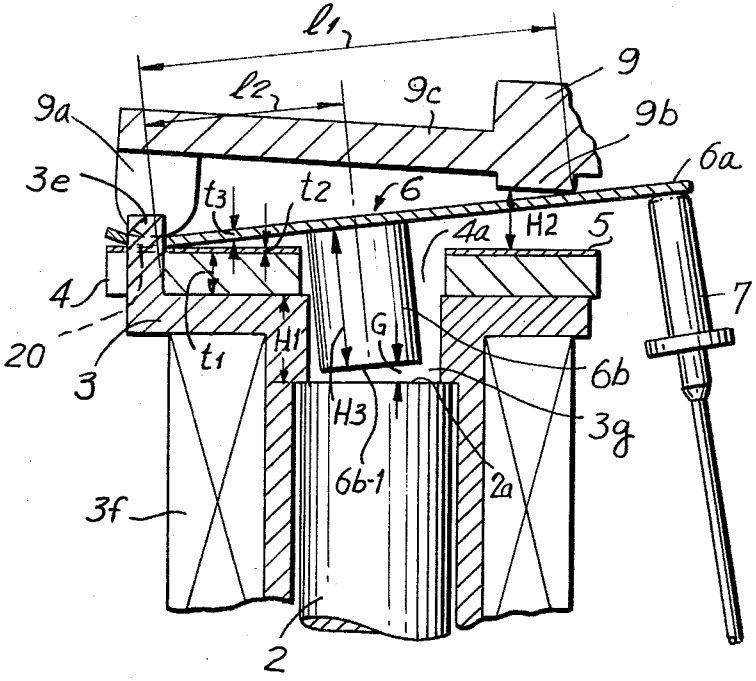
FIG. 6 is a segmental view, similar to FIG. 1, showing the driving mechanism for the print needle of this invention.

The needle 7 is biased in the direction of the arrow B (FIG. 1) by the spring 8, one end of which rests against the surface 10*a*-5 which is part of the needle guide 10. In order to fix the position of the movable chip 6 when the electric coil 3*f* is not energized, that is, the standby condition, the lever 6*a* of the chip 6 is pushed against the the spacer 5 proximate the contact point 20 by means of a semi-circular portion 9*a* on the lever suppress member 9. And the end 6*a*-2 of the lever 6 in the vicinity of the needle 7 is brought to rest by the stop portion 9*b* of the lever suppress member 9 (FIGS. 1, 6). The movable iron core 6*b* attached to the base 6*a* of the lever or chip 6 fits into the associated aperture 4*a* on the second yoke 4 and extends into the associated aperture 3*g* of the coil frame 3. The movable iron core 6*b* is in a condition to oscillate with the lever 6.

When the coil 3*f* is energized, a magnetic flux is generated which passes through the fixed iron core 2, the first yoke 1, the second yoke 4 and the movable lever 6, which is of iron. The movable lever 6 is attracted to the fixed iron core 2. Accordingly, the needle 7 is pushed outwardly in the direction indicated by the arrow A in FIG. 1, against the force of the biasing spring 8 which is compressed. A printing medium (not shown) is struck by the end 22 of the needle 7 to effect printing. The needles 7 extend beyond, that is to the right, of the surface 23 (FIG. 1) at the end of the needle guide 10 when printing. After the act of printing, the electric energization of the coil 3*f* is terminated, and the attractive force between the movable lever 6 and the fixed iron core 2 is removed. The needle 7 pulls back in the direction as indicated by the arrow B in FIG. 1, due to both the force of the biasing spring 8 and the repelling power, that is, the bounce applied to the needle, as the result of printing against a platen (not shown). The lever 6 comes to rest against the stop portion 9*b* of the lever-suppress member 9.

Figure 4A:
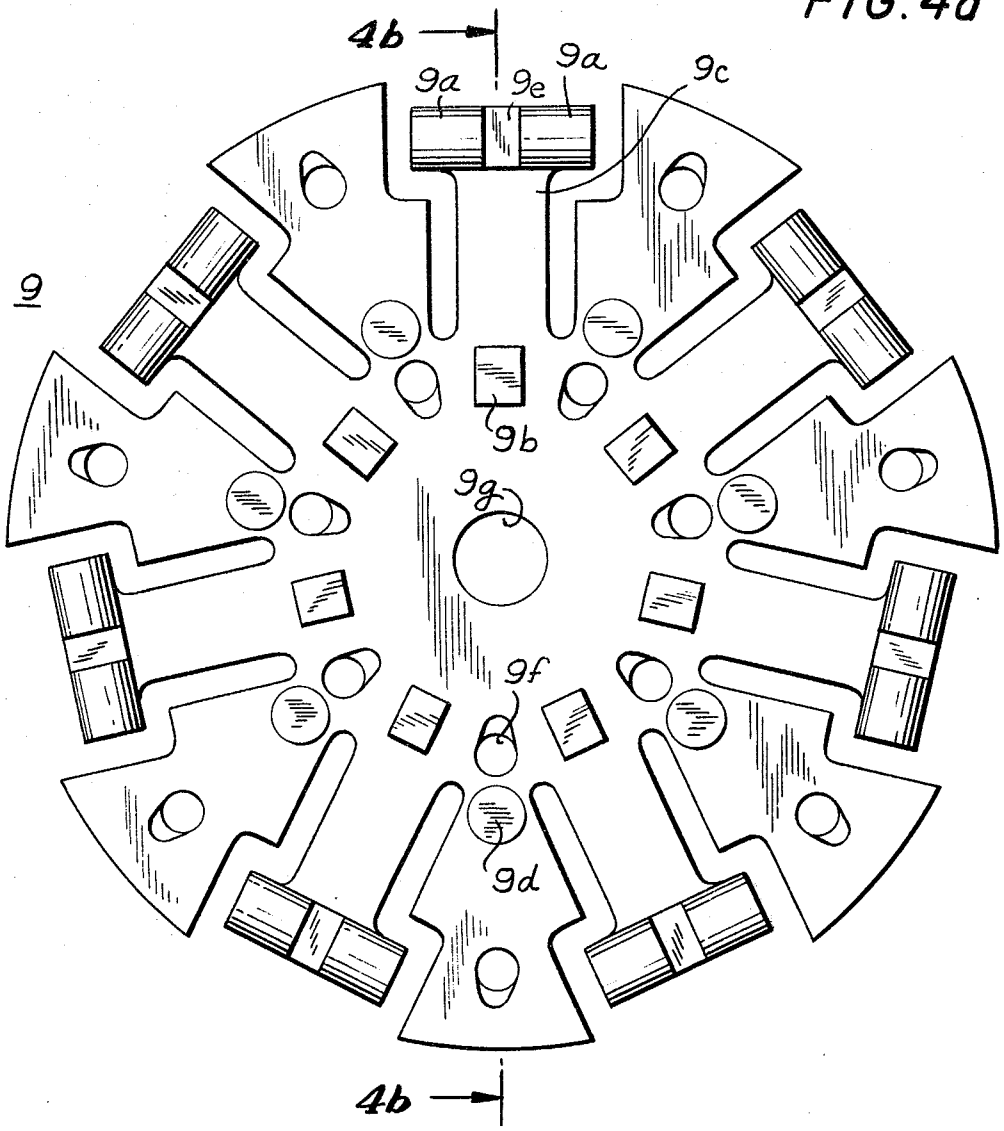
FIG. 4*a* is a plan view of the lever-suppress member of the dot printer of FIG. 1.
Figure 4B:
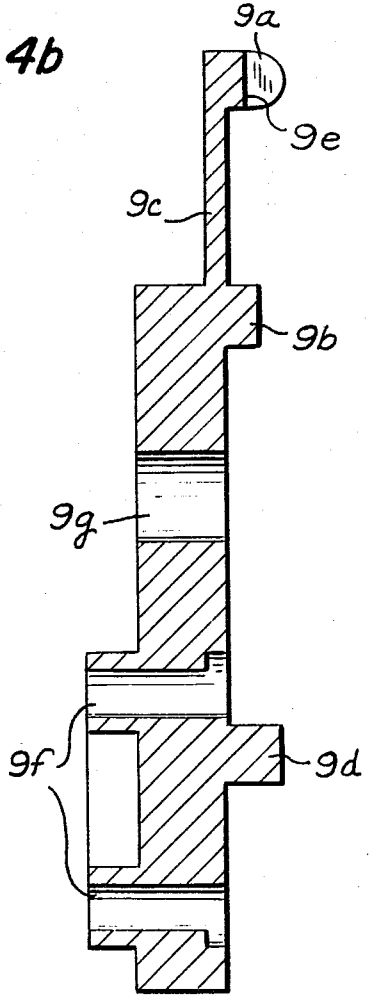
FIG. 4*b* is a section view taken along the line 4*b*—4*b* of FIG. 4*a*.

The lever-suppress member 9 performs many functions. With reference to FIGS. 4*a* and 4*b*, the surface 9*a* of the lever-suppress member 9 which contacts the iron core base 6*a* of the lever 6 is supported by a leaf spring 9*c*, which is an integral portion of the suppress member 9. The portion 9*a* elastically presses on the bent portion of the lever base 6*a*, substantially opposing the contact point 20 of the lever 6 with the spacer 5. The distance of the stop portion 9*b* from the spacer 5 is set by a projection 9*d* provided on the lever-suppress member 9 which touches the spacer 5. The angular position of the suppress member 9 is fixed by the insertion of the fulcrum projection 3*e* on the coil frame 3 into the guide groove 9*e* which divides the lever-suppress portion 9*a* (FIG. 4*a*). The coil lead terminals 12 pass through apertures 9*f* in the suppress member 9 and the ends of the coil lead terminals 12 are connected to the circuit substrate 15. The lever-suppress member 9 is attached, and the entire assembly is rigidized, with the exception of the movable parts, by the screw 13 which extends through the central opening 9*g* in the suppress member 9 and is threaded into the needle guide 10. The columnar portion 10*b*-2 of the needle guide 10 fits into the guide opening 9*g* of the lever-suppress member 9 to prevent any slipping action between the members.

The needle guide 10 is broadly divided into two elements, namely the needle guide 10*a*, and the needle guide 10*b*. The needle guide 10*a* is provided (FIG. 1) with a head guide 10*a*-1 and middle guide 10*a*-2 and 10*a*-3, each of which is provided with seven apertures for guiding the needles 7. Similarly, the needle guiding portion 10*b*-1 of the needle guide 10*b* is provided with seven apertures for guiding the needles 7. Each of the apertures 10*b*-1 for guiding a needle 7 is located so as to smoothly guide the needle in its motion toward the printing medium.

The needle 7 comprises a wire 7*a* and a wire base 7*b*. The wire 7*a* and the wire base 7*b* are fixedly connected by means of welding, adhesive, or the like. The collar 7*c* extends from the needle base 7*b* to provide a point of engagement for the biasing spring 8, and the surface 10*a*-4 includes the recess 10*a*-5 to receive the other end of the spring 8.

Figure 5:
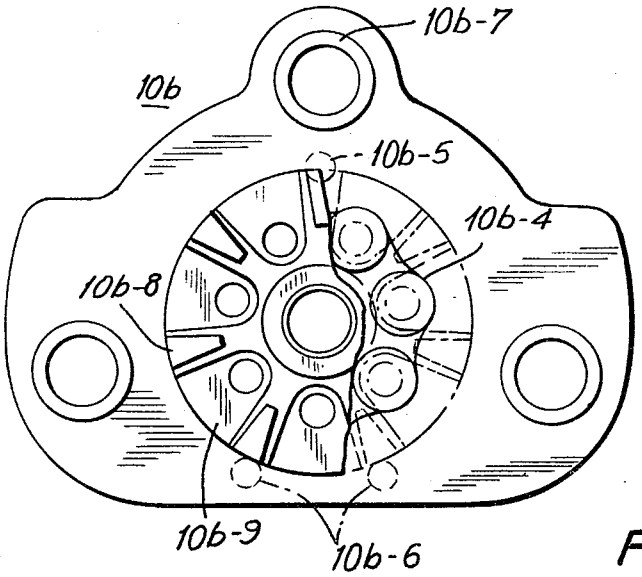
FIG. 5 is a rear view of the needle guide of the dot printer head of FIG. 1.

Assembly of the needle 7 into the needle guide 10 is as follows. After the needle 7 has been passed through the coil biasing spring 8, the needle 7 is passed through the aperture for guiding the needle in the element 10*a*, entering the guide element 10*a* from the surface 10*a*-4. The base 7*b* of the needle extends outwardly from the surface 10*a*-4 toward the guide element 10*b*. The end 10*a*-4 is inserted into the element 10*b*, entering the cup-like cavity 10*b*-3 of the needle guide 10*b*. The base 7*b* of the needle 7 is inserted into the aperture 10*b*-1 for guiding the needle through the element 10*b*, where the remote end of the needle base 7*b* contacts the lever 6. A guide wall 10*b*-4 shown in FIG. 5, is provided on the inside of the cavity 10*b*-3 in the needle guide 10*b*, so as to naturally guide the wire base 7*b* into the aperture 10*b*-1 during assembly. Then the two needle guide elements 10*a*, 10*b*, which are separate components, are combined by pressing a guide portion 10*b*-5 which protrudes from the front of the guide element 10*b* into the guide aperture 10*a*-6 provided in the needle guide element 10*a*.

Another two guide projections 10*b*-6 extend from the needle guide element 10*b*. When the elements 10*a* and 10*b* are telescoped together, there is a press fit between the projections 10*b*-6 and the side surfaces 10*a*-7 (FIG.

2) on the element 10*a*. This makes for a more stable and reliable structure. Pressure welding at this joint has been used satisfactorily. At the time of assembling the entire printing head, the needle 7 and the needle guides 10*a*, 10*b* can be preassembled into one block which does not allow escape of the needle 7. As stated above by having two elements 10*a*, 10*b* to guide the needle 7, which elements are then combined into a unitary component, the entire assembly of the head is facilitated and an advantageous design is achieved.

The needle guide 10, which thus becomes one block by joining the elements 10*a*, 10*b*, is joined to the first yoke 1 by the screw 14 with a radiating board 11 interposed between the needle guide 10 and the first yoke 1. The radiating board 11 is used to dissipate the thermal energy generated in the magnetic coils 3*f* during operation of the print head. The screw 14 passes through the opening in the projection 10*b*-7 on the needle guide element 10*b* and through the opening 11*a* in the radiating board 11. Thus, the angular position of the radiating board 11 is easily fixed by the screw 14 and the needle guide 10*b* which passes through the central opening of the radiating board 11.

The relative positions of other components are fixed as follows. The columnar portion 10*b*-2 extends away from the cavity 10*b*-3 in the needle guide 10*b*. This column 10*b*-2 fits in the center of the needle guiding portion 10*b*-1 and passes through the guide opening 9*g* of the lever-suppress member 9 and is engaged by the screw 13 which has a head overlapping the surface of the lever-suppress member 9. The guide projection 10*b*-8 prevents lateral deflection of the end 6*a*-2 of the movable lever or chip 6 which engages the needle 7. The recesses 10*b*-9 in the needle guide element 10*b* receive the guiding projections 4*f* centrally located on the second yoke 4 and fix the relative angular position between the needle guide 10 and the second yoke 4.

The needle guide element 10*a* includes lateral flanges 10*a*-8 for joining the whole dot printer head to a head-holding fixture 16 by means of screws 17. The aperture 10*a*-9 in the flanges 10*a*-8 are elliptically-shaped in the longitudinal direction of the needle guide 10 so that by loosening the screw 17, the distance between the head guide 10*a*-1 and a platen (not shown) is freely adjusted when the dot printer is assembled.

The radiating board 11 includes a plurality of bent leaves 11*b* which extend along the outer periphery of the first yoke 1 as shown in FIG. 2. These leaves 11*b* are provided in order to increase the area for heat radiation. In an alternative embodiment of this invention additional radiating leaves may be interposed between the radiating board 11 and the first yoke 1 and between the radiating board 11 and the needle guide 10 such that an increased area for heat radiation is provided.

The chordal segment 1*a* in the first yoke 1, which deviates from the perfect cylindrical shape of the component, provides a better line of vision when looking at the printing position of the head, that is, toward the platen (not shown) from the back of the dot printer head of this invention.

The spacer 5 is provided to prevent rubbing and corrosion, that is, rust, adjacent to the fulcrum contact point 20 of the movable lever 6 with the second yoke 4. The spacer 5 is made of extremely thin plastic sheet and is unnecessary when the contacting surface 20 at the fulcrum of the movable lever 6 is made of plastic material or is coated by a plastic, or when the second yoke 4 is coated with a plastic material or made from a suitable material. In an embodiment which uses a plastic coating, the coating layer can be considered as the equivalent of the spacer 5.

The structure of the printer head of this invention has been described above and a great advantage derived from this invention is as follows. As may be best seen in FIG. 6, there is a gap G between the fixed iron core 2 and the movable iron core 6*b* attached to the lever 6 when the lever 6 is in the standby condition. The size of the gap G determines the amount of energy and the size of the electromagnet which is required to drive the needle 7 with sufficient speed over a proper distance. The gap width G is generally determined by (a) the thickness $H_1$ of the portion of the coil frame 3 between the fixed iron core 2 and the second yoke 4, (b) the thickness $t_1$ of the second yoke 4, (c) the thickness $t_2$ of the spacer 5, (d) the distance $H_2$ between the spacer 5 and the stop 9*b* of the lever-suppress member 9, (e) the thickness $t_3$ of the iron lever base 6*a*, (f) the height $H_3$ of the movable iron core 6*b*, (g) the distance $l_1$ between the fulcrum contact 20 of the movable chip 6 and the stop 9*b*, and (h) the distance $l_2$ between the fulcrum contact 20 of the movable chip 6 and the movable iron core 6*b*. The gap G can be approximately formularized as follows:

$$G=H_1+t_1+t_2+l_2(H_2-t_3)/l_1-H_3 \quad (1)$$

On the other hand, an important primary factor for controlling printing quality is speed of the needle 7 at the time when the needle strikes the printing medium. Generally, printing quality is improved by making the impact speed faster by increasing the input energy to the electromagnet. But, beyond a certain quality level, further improvement in quality cannot be distinguished by the eye. On the other hand, the printing quality becomes extremely deteriorated when the speed of needle impact falls below a certain level. Considering the input energy, it is desirable for a dot printer head that the impact speed of the needle is near the minimum speed which obtains a printing quality which satisfies a man's eye. The speed should change as little as possible to provide uniform printing quality. One factor which greatly influences the above-mentioned change of speed is variation in the gap G between the attracted surface 6*b*-1 of the movable iron core 6*b* and the attracting surface 2*a* of the fixed iron core 2. For the dot printer head of this invention, a representative value G of the gap is approximately expressed by the equation (1) as discussed above. The most deteriorated variation $\Delta G$ of the value G can be expressed as follows when the ratio of $l_2/l_1$ is considered fixed.

$$\Delta G=\Delta H_1+\Delta t_1+\Delta t_2+l_2(\Delta H_2+\Delta t_3)/l_1+\Delta H_3$$

$\Delta H_1$, $\Delta H_2$, $\Delta H_3$, $\Delta t_1$ $\Delta t_2$ and $\Delta t_3$ are variations of $H_1$, $H_2$, $H_3$, $t_1$, $t_2$, and $t_3$ respectively.

In the structural design according to this invention, it is possible to eliminate the need to have the gap G adjustable. This is possible because there are very few variables which determine the magnitude of the gap G and it is easy to control these variables in mass production, because these variables primarily lie in simple dimensions of the components. As a result in mass production the $\Delta G$ can be made extremely small. Such a structure without the need to adjust the gap G greatly contributes to cost reduction in production and the entire structure is easily assembled.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A dot printer head comprised of:

a first yoke, having a first magnetically permeable core fixed thereon;

a coil frame, said coil frame having an opening in one surface and receiving said first core therein, said opening having a stepped portion, one end surface of said magnetic core being in abuttment with said stepped portion and said coil frame having a fulcrum projection extended therefrom;

a coil, said coil being wound on the outer periphery of said coil frame, said coil being proximate said first yoke and first core, electrically energizing said coil inducing a magnetic field in said first core, and de-energizing said coil extinguishing said magnetic field;

a lever, said lever having a curved segment proximate one end, said curved segment having an aperture therethrough, said fulcrum projection of said coil frame being inserted through said aperture disposed in said curved segment to form a fulcrum for pivoting said lever;

a second magnetically permeable core fixedly attached to said lever, said second core being within said magnetic field of said first magnetic core, and being attracted toward said first core when said coil is energized;

a second yoke, said second yoke abutting on a surface of said coil frame opposite to said surface having said opening in which said first core is inserted;

a needle, said needle contacting the other end of said lever, said needle being substantially longitudinally driven;

guide means for directing the longitudinal path of said needle when driven;

restraining means, said restraining means including a hold portion, stop portion and flexible segment, said hold portion constraining said curved segment, said stop portion limiting the return travel of said lever when said coil has been de-energized after printing;

return means for moving said lever and for maintaining contact between said needle and said lever when said coil is de-energized;

whereby said lever pivots and said needle is driven along a guided path for printing when said coil is energized.

2. The dot printer head of claim 1, wherein said restraining means includes a projection for fixing the position of said stop portion.

3. The dot printer head of claim 2, wherein said restraining means is one body, said flexible segment being between said hold portion and said stop portion.

4. The dot printer head of claim 1, wherein said lever is positioned between said restraining means and a planar surface, said lever pivoting by a rolling motion of said curved segment on said lever on said planar surface while constrained by said curved surface on said restraining means.

5. The dot printer head of claim 1, and further comprising means for limiting the driving motion of said lever when said coil is energized whereby the forward movement of said needle in the longitudinal direction is limited and the return longitudinal motion of said needle is limited by said means for limiting the return travel of said lever.

6. The dot printer of claim 1 or 3, wherein said flexible segment is a leaf spring.

7. The dot printer head of claim 1, wherein said second magnetically permeable core is fixedly attached between said ends of said lever whereby said longitudinal driven motion of said needle at said other end of said lever is greater in distance than the motion of said second permeable core when said coil is energized.

8. The dot printer head of claim 1, wherein said first yoke, said coil, said stop portion, said means for limiting said driving motion of said lever when said coil is energized, are physically fixed in relationship one to the other, and said curved segment is substantially fixed and restrained by said restraining means in relation to said first yoke, the action of said return means urging said lever to rest against said fixed stop, leaving a gap of substantially fixed dimension between said first core and said second core when said coil is not energized, whereby when said coil is energized said needle travels through a path of fixed length, at known velocities, and said gap need not be adjusted.

9. The dot printer head of claim 1, wherein said coil frame includes a projection for guiding said yoke to a predetermined position, and an opening for inserting said second core.

10. The dot printer head of claim 1, wherein a cross-section of said movable lever, excluding said second core, is substantially U-shaped.

* * * * *

UNITED STATES PATENT AND TRADEMARK OFFICE

CERTIFICATE OF CORRECTION

PATENT NO. : 4,244,658

DATED : January 13, 1981

INVENTOR(S) : MASAHIKO MORI

It is certified that error appears in the above—identified patent and that said Letters Patent is hereby corrected as shown below:

On the title page, please insert

-- [73] Assignee: Kabushiki Kaisha Suwa Seikosha, Tokyo, Japan and Shinshu Seiki Kabushiki Kaisha, Nagano-ken, Japan --

Signed and Sealed this

*Thirteenth* Day of *April 1982*

[SEAL]

*Attest:*

GERALD J. MOSSINGHOFF

*Attesting Officer*

*Commissioner of Patents and Trademarks*